United States Patent [19]

Ashford et al.

[11] Patent Number: 4,992,346

[45] Date of Patent: Feb. 12, 1991

[54] PRODUCTION OF HOLOGRAMS

[75] Inventors: Neil F. Ashford, Crewe; Peter M. Blum, Altrincham; Stephen R. Postle, Oxford; Alan Hodgson, Stockport, all of United Kingdom

[73] Assignee: Ilford Limited, Cheshire, United Kingdom

[21] Appl. No.: 452,843

[22] Filed: Dec. 19, 1989

[30] Foreign Application Priority Data

Dec. 20, 1988 [GB] United Kingdom ..... 8829698

[51] Int. Cl.[5] ..... G03C 1/04

[52] U.S. Cl. ..... 430/2; 430/1; 430/430

[58] Field of Search ..... 430/1, 2, 430, 432

[56] References Cited

U.S. PATENT DOCUMENTS 4,769,300 9/1988 Butcher ..... 430/2

FOREIGN PATENT DOCUMENTS 0230208 7/1987 European Pat. Off. .
0332577 9/1989 European Pat. Off. .

*Primary Examiner*—Marion C. McCamish
*Assistant Examiner*—J. Weddington
*Attorney, Agent, or Firm*—Darby & Darby

[57] ABSTRACT

There is described a method of processing exposed holographic material to obtain holograms having a broader band replay a hologram which is of the silver halide in gelatin binder type which method comprises holographically exposing the holographic material by use of coherent light, developing the holographic image by a chemical process and then treating the material sequentially either firstly with a solution of an anionic surfactant which comprises at least one alkyl group having at least four carbon atoms and then with a solution of a quaternary ammonium compound which comprises at least one alkyl group having from 10 to 18 carbon atoms or a polymeric compound which comprises at least one quaternary ammonium group in the repeating unit or firstly with a solution of said quaternary ammonium compound or polymeric compound and then with a solution of an anionic surfactant, the material being subjected to a silver bleaching step at one stage after development.

Preferably the anionic surfactant is present either in an acid stop bath after the development bath or in the bleach bath which is an acid bath. Then after the bleach bath the material is treated with the aqueous solution of the quaternary ammonium compound.

11 Claims, No Drawings

PRODUCTION OF HOLOGRAMS

This invention relates to the production of holograms from silver halide sensitized holographic material.

In general holograms produced from silver halide sensitized holographic material exhibit a narrow band replay at peak reflectivity of about 30 nm. Very often this is satisfactory but for display holograms if the hologram has a broader band reflectivity then a brighter hologram is obtained. Further if the hologram is of a mirror and it is desired to use the hologram for solar rejection then as broad a replay band as possible is required. Further it is sometimes found that changes to the design of holographic material such as increases in layer thickness for example for colour holoqraphy produce less than ideal band widths and less bright holograms. In such cases it is desirable to increase the band width and achieve a brighter hologram.

Some small increases in the width of the peak replay band can be obtained by treating the holograms after processing with either a cationic or an anionic surfactant. Such treatment is described in E.P. No. 230208 for cationic surfactants. Treatment of holograms using an anionic surfactant is described in one of our co-pending patent applications. We have found a method of processing holograms to produce a hologram with a broader band replay.

Therefore according to the present invention there is provided a method of preparing a hologram which is of the silver halide in gelatin binder type which method comprises holographically exposing the holographic material by use of coherent light, developing the holographic image by a chemical process and then treating the material sequentially either firstly with a solution of an anionic surfactant which comprises at least one alkyl group having at least four carbon atoms and then with a solution of a quaternary ammonium compound which comprises at least one alkyl group having from 10 to 18 carbon atoms or a polymeric compound which comprises at least one quaternary ammonium group in the repeating unit or firstly with a solution of said quaternary ammonium compound or polymeric compound and then with a solution of an anionic surfactant, the material being subjected to a silver bleaching step at one stage after development.

The treatment solution should not contain both a compound containing a quaternary ammonium group and an anionic surfactant as improvements in broad band replay are not obtained using this solution. Preferably both the solution which comprises the said quaternary ammonium compound and the solution which comprises the said anionic surfactant are aqueous solutions.

Preferably the aqueous solution which comprises the said anionic surfactant has a pH below 5. Preferably the aqueous solution which comprises the said quaternary ammonium compound has a pH above 8.

The usual processing sequence for holographic material which uses silver halide as the sensitive system is silver halide development using a silver halide developing agent for example hydroquinone, followed by a silver bleaching process.

The silver bleaching step may be any process of removing the developed silver, but which leaves the unexposed silver halide in situ. It is to be understood that the developed silver may be converted to silver halide some of which may remain in the holographic material.

Examples of bleaching techniques are solvent bleaching method in which the developed silver is removed from the material and rehaligenated bleaching methods, in which the developed silver is converted to silver halide.

Preferably after the holographic exposure and silver development the material is treated with an aqueous solution of the said anionic surfactant which may be present in a stop bath between silver halide development and the bleaching step or in the bleach bath or in a bath in which the material is treated after bleaching and then the material is treated with an aqueous solution of the said quaternary ammonium compound.

Most preferably the anionic sulfactant is present either in an acid stop bath after the development bath or in the bleach bath which is an acid bath. Then after the bleach bath the material is treated with the aqueous solution of the quarternary ammonium compound.

Preferably there is a process step between the treatment with the solution of the anionic surfactant and the treatment with the quarternary ammonium compound. The material may be treated first with the quaternary ammonium compound solution and then with the anionic sulfactant but this is not preferred.

Thus the preferred processing sequence for the exposed holographic material is silver halide development, aqueous acid stop bath which comprises the said anionic surfactant, silver bleach bath, water wash bath, aqueous bath which comprises the said quaternary ammonium compound, followed optionally by a water wash. Preferably the concentration of anionic surfactant in the aqueous treatment bath is from 1 to 5% weight for weight.

The preferred length of treatment with te anionic surfactant solution is at least two minutes. A suitable length of treatment is from 2 to 5 minutes.

A preferred concentration of the solution of quaternary ammonium compounds to use is from 1 to 20g per 100 ml of water. A suitable treatment time is from 2 to 5 minutes.

Preferably the anionic surfactant comprises at least one alkyl group having at least eight carbon atoms.

By anionic surfactant or suriace active agent is meant an anionic compound which has both a hydrophilic and a hydrophobic portion in the molecule and thus which is able to act as a surface active agent.

Several classes of anionic surfactants are known but the preferred classes to use in the process of the present invention are alkyl sulphonates, alcohol sulphates, ether sulphates, phosphate esters and sulphosuccinates. Particularly useful alkyl su)phonates are alkylbenzene sulphonates of the general formrla I:

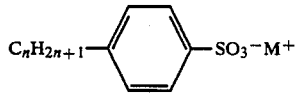

wherein $C_nH_{2n+1}$ is an alkyl group which may be a linear chain or a branched chain, n is at least 4 but can be up to 30, M is a metal ion, or an ammonium or amine group.

Preferably n is from 8 to 16. Most commonly M is sodium and n is 12.

A commercially available alkyl sulphonate of particular use in the present invention is marketed by Lankro Chemicals Limited under the trade name ARYLAN SC30 which is used the Example which follows.

Particularly useful alcohol sulphites are compounds of the general formula II:

$$CH_3(CH_2)_nCH_2OSO_3^-M^+$$

wherein n is at least 3 but can be up to 30 and M is metal ion or an ammonium or amine group.

Preferably M is sodium and n is at least 8 and most preferably 12.

Compounds of formula II are sometimes more correctly called alkyl sulphates.

A particularly useful compound of formula II is sodium lauryl sulphate which is a commercially available surfactant.

Particularly. useful ether sulphates are compounds of the general formula III:

$$CH_3(CH_2)_xCH_2(O\ CH_2CH_2)_nOSO_3^-M^+$$

and of general formula IV

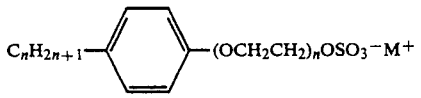

where x is at least 3 but can be up to 30 and n is at least 2 but can be up to 15 and M is a metal ion or an ammonium or amine group.

Preferably n is 2 or 3.

Triton 770 is an example of such an ether sulphate of formula IV. The $(CH_2)_x$ alkyl group is preferably a linear group but may be a branched chain. Preferably x is 10 to 12.

A particularly useful compound of formula IV is marketed by Lankro Chemicals Limited under the trade name of PERLANKROL RN 75.

Particularly useful phosphate esters are compounds of general formula V:

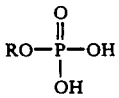

or of the general formula VI:

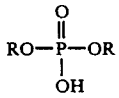

wherein R is the residue of an alcohol, an alkyl phenol or an ethoxylate.

Examples of suitable alcohols are alcohols having an alkyl moiety of 6 to 16 carbon atoms which may have a straight or a branched chain. N-octanol and N-decanol are the preferred alcohols for use in the invention.

Examples of suitable alkyl phenol are nonylphenol and octylphenol.

Examples of suitable ethoxylate are groups of the formula $(CH_2CH_2O)$—H wherein n is from 5 to 20 and is preferably 10.

These phosphate esters are prepared by reacting an alcohol, and alkyl phenol or an ethoxylate with phosphoric acid or phosphorous pentoxide. Usually a mixture of esters of formulae V and VI is obtained.

A particularly useful alkylphenol polygycol ether phosphate ester which is possibly a mixtures of compounds of formula V and formula VI is marketed by REWO Chemicals Limited under the trade name of REWOPHAT E1027.

Particularly useful sulphosuccinates are compounds of the general formula VII

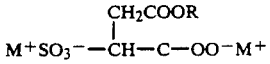

or of the general formula VIII:

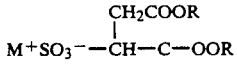

wherein the above two formulae $M^+$ is a metal ion and R is an alkyl group, an ethoxylate group or an alkylphenol group each having at least 4 carbon atoms. Examples of suitable alkyl, alkylphenol and ethoxylate groups are the same as given for the compounds of formulae V and VI.

M can be sodium, lithium, or potassium. Preferably M is sodium. R can be an alkyl group having between 6 and 20 carbon atoms. Preferably, R is a straight chain alkyl group having from 10 to 12 carbon atoms.

A particularly useful sulphosuccinate is the disodium ethxylated nonylphenol half ester of sulphosuccinic acid marketed by Cyanamid under the trade name of AEROSOL A-103.

It is to be understood that all the commercially available surfactants due to their manner of manufacture have a structure which is difficult to determine with any great accuracy but all the manufacturers state to which general class their named surfactants belong.

All the quaternary ammonium compounds described in published European patent application No. 230208 are of use in the present invention. Especially useful are the following compounds:

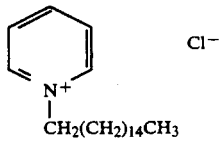

which is used in the Example and called A; and N-dodecyldimethylbenzyl ammonium chloride

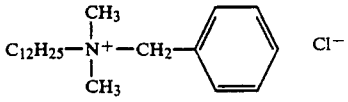

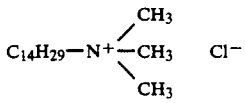

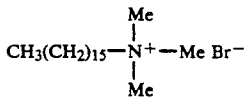

which is also used in the Example and called B.

As polymeric compositions there may be used in the present invention the polymeric compounds disclosed in published European Patent Application No. 230208.

The following Example will serve to illustrate the invention.

EXAMPLE 1

Samples of holographic material were prepared by coating onto a transparent photographic film base a gelatino silver halide emulsion which was substantially pure silver bromide having a mean crystal size of 0.04 microns at a silver coating weight of 30 mg/dm$^2$. The emulsion was optically sensitised with a red sensitising dye so that it was optimally sensitive to 633 nm the colour of a He:Ne laser.

The material was holographically exposed by a Denisyuk exposure method using a plane mirror plate as an object to yield (after processing) a reflective hologram.

The material was then developed for 3 minutes in a solution of the following formulation

| | |
|---|---|
| Ascorbic acid | 35 g |
| potassium carbonate | 50 g |
| water to 1000 mls | |

This was followed by an acid stop bath in which the developed material was immersed for three minutes. In this bath which had a pH of 2 there was present as indicated in the results table 2% w/v of an anionic surfactant. In some tests no surfactant was present in this bath.

The material was then transferred to a rehalogenating bleach bath of the following composition until all silver metal had been bleached out, approximately 2 minutes.

| | |
|---|---|
| Fe Na EDTA (1.8 m Solution) | 150 ml |
| KBr | 20 g |
| Water to | 1000 ml |

After a 2 minute water wash the material was transferred to an aqueous solution of a cationic surfactant active agent at 2% w/w for 3 minutes. The pH of this solution was 10. Sometimes as indicated this step was omitted.

Finally the material was washed in running water for 2 minutes.

Eight tests were carried out and the peak λ replay and the band width was determined for each test. The results are shown in the table below.

| Bath No. | Anionic surfactant | Cationic surfactant | Band width (nm) | λ replay |
|---|---|---|---|---|
| 1 | None | None | 30 | 580 |
| 2 | Arylan SC30 | None | 40 | 730 |
| 3 | Triton 770 | None | 36 | 825 |
| 4 | None | A | 53 | 706 |
| 5 | None | B | 54 | 740 |
| 6 | Arylan SC30 | A | 62 + 66 | 592 + 744 |

-continued

| Bath No. | Anionic surfactant | Cationic surfactant | Band width (nm) | λ replay |
|---|---|---|---|---|
| 7 | Arylan SC30 | B | 56 + 45 | 601 + 736 |
| 8 | Triton 770 | B | 130 | 647 |

In the cases of the baths conforming to the method of the present invention that is to say baths 6, 7 and 8 the peak λ replay is less than when a single surfactant is used but the bandwidth has been greatly extended. In the case of bath 6 and 7 the bandwidth has two distinct peaks but the aggregate is a replay bandwidth of greater than 100 nm.

We claim:

1. A method of preparing a hologram which is of the silver halide in gelatin binder type which method comprises holographically exposing the holographic material by use of coherent light, developing the holographic image by a chemical process the method being characterised in that then the material is treated sequentially either firstly with a solution of an anionic surfactant which comprises at least one alkyl group having at least four carbon atoms and then with a solution of a quaternary ammonium compound which comprises at least one alkyl group having from 10 to 18 carbon atoms or a polymeric compound which comprises at least one quaternary ammonium group in a repeating unit or firstly with a solution of said quaternary ammonium compound or polymeric compound and then with a solution of an anionic surfactant, the material being subjected to a silver bleaching step at one stage after development.

2. A method according to claim 1 characterised in that both the solution which comprises the said quaternary ammonium compound and the solution which comprises the said anionic surfactant are aqueous solutions.

3. A method according to claim 2 characterised in that the aqueous solution which comprises the said anionic surfactant has a pH below 5.

4. A method according to claim 2 characterised in that the aqueous solution which comprises the said quaternary-ammonium compound has a pH above 8.

5. A method according to claim 1 chracterised in that after the holographic exposure and silver development the material is treated with an aqueous solution of the said anionic surfactant which may be present in a stop bath between silver halide development and the bleaching step or in the bleach bath or in a bath in which the material is treated after bleaching and then the material is treated with an aqueous solution of the said quaternary ammonium compound.

6. A method according to claim 1 characterized in that the anionic surfactant used is selectel from alkyl sulphonates, alcohol sulphates, ether sulphates, phosphate esters and sulphosuccinates.

7. A method according to 6 characterised in that claim the alkyl sulphonates used are of the general formula

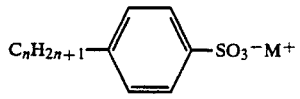

wherein $C_nH_{2n+1}$ is an alkyl group which may be a linear chain or a branched chain, n is at least 4, M is a metal ion, or an ammonium or amine group.

8. A method according to claim 1 characterised in that there is used quaternary ammonium compounds of the general formula:

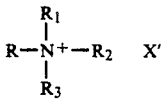

wherein R is a straight chain alkyl group having 10 to 18 carbons atoms, $R_1$ and $R_2$ are each alkyl groups having 1 to 2 carbon atoms and $R_3$ is either an alkyl group having 1 to 2 carbon atoms, or an alkyl group or an cycloalkyl group or a group of formula

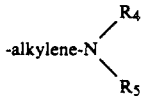

where $R_4$ and $R_5$ an each alkyl groups having 1 to 2 carbon atoms, or $R_1$, $R_2$ and $R_3$ represent the atoms necessary to complete a heterocyclic aromatic ring.

9. A method according to claim 8 characterised in that the quaternary ammonium compounds used is selected from

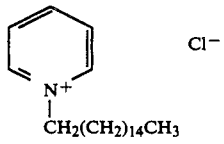

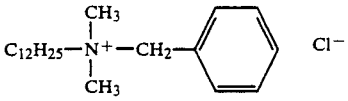

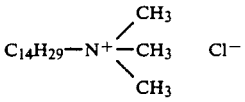

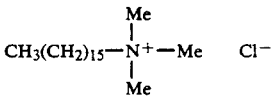

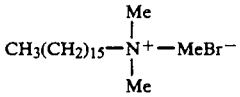

10. A method for preparing a eilver halide gelatin binder type hologram comprising the steps of:

exposing a holographic material to coherent light to create a latent holographic image;

developing the latent holographic image with a silver halide developing agent;

treating said holographic material with an anionic surfactant comprising at least one alkyl group having at least 4 carbon atoms;

and, thereafter, treating the holographic material with a member selected from the group consisting of a solution of a quaternary ammonium compound which comprises at least one alkyl group having from 10 to 18 carbon atoms, and a polymeric compound which comprises at least one quaternary ammonium group in a repeating unit;

and subjecting said exposed holographic material to a silver bleaching process.

11. The method of claim 10 which comprises first treating said exposed holographic material with a solution of said quaternary ammonium compount or said polymeric compound and thereafter treating said exposed material with a solution of said anionic surfactant.

* * * * *